US010192705B2

(12) United States Patent
Straub et al.

(10) Patent No.: US 10,192,705 B2
(45) Date of Patent: Jan. 29, 2019

(54) FUSE ELEMENT, A FUSE, A METHOD FOR PRODUCING A FUSE, SMD FUSE AND SMD CIRCUIT

(71) Applicant: SCHURTER AG, Lucerne (CH)

(72) Inventors: Peter Straub, Oberwil/Zug (CH); Hans-Peter Blättler, Adligenswil (CH)

(73) Assignee: SCHURTER AG, Lucerne (CH)

( * ) Notice: Subject to any disclaimer, the term of this patent is extended or adjusted under 35 U.S.C. 154(b) by 0 days.

(21) Appl. No.: 15/107,091

(22) PCT Filed: Dec. 23, 2013

(86) PCT No.: PCT/EP2013/077913
§ 371 (c)(1),
(2) Date: Jun. 21, 2016

(87) PCT Pub. No.: WO2015/096853
PCT Pub. Date: Jul. 2, 2015

(65) Prior Publication Data

US 2017/0040136 A1 Feb. 9, 2017

(51) Int. Cl.
*H01H 85/08* (2006.01)
*H01H 85/20* (2006.01)
(Continued)

(52) U.S. Cl.
CPC ..... *H01H 85/08* (2013.01); *H01H 69/02* (2013.01); *H01H 85/0411* (2013.01);
(Continued)

(58) Field of Classification Search
CPC .... H01H 69/02; H01H 85/0411; H01H 85/11; H01H 85/06; H01H 85/08; H01H 85/20; H01H 85/205
(Continued)

(56) References Cited

U.S. PATENT DOCUMENTS 3,838,376 A * 9/1974 Norholm ..... H01H 85/055 337/160
4,219,795 A * 8/1980 Panaro ..... H01H 85/055 337/163
(Continued)

FOREIGN PATENT DOCUMENTS

DE 10-2005-002091 7/2006
WO 1999/016097 4/1999

OTHER PUBLICATIONS

International Search Report and Written Opinion for PCT/EP2013/077913 dated Sep. 18, 2014, 15 pgs.

*Primary Examiner* — Anatoly Vortman
(74) *Attorney, Agent, or Firm* — Procopio, Cory, Hargreaves & Savitch LLP

(57) ABSTRACT

The invention relates to a fuse element (12_1; 12_2), comprising two connecting contacts (24_1', 24_1"; 24_2', 24_2") and an interposed conductive track (26_1; 26_2), wherein the conductive track (26_1; 26_2) has a reduced line-cross-section, in relation, to the connecting contacts (24_1', 24_1"; 24_2', 24_2") at least in some sections, further comprising at least one overlay (16_1; 16_2', 16_2"), wherein the fuse element (12_1; 12_2) and the overlay (16_1; 16_2', 16_2") each comprise materials which undergo diffusion when a predetermined ambient temperature is exceeded and when an electric current is conducted by the fuse element (12_1; 12_2). The invention further relates to a fuse (TO) having such a fuse element (12_1; 12_2) and a base support (14), wherein the fuse element (12_1; 12_2) is disposed on a surface of the base support (14).

13 Claims, 2 Drawing Sheets

(51) Int. Cl.

| | |
|---|---|
| ***H01H 69/02*** | (2006.01) |
| ***H01H 85/041*** | (2006.01) |
| ***H01H 85/11*** | (2006.01) |
| ***H01H 85/06*** | (2006.01) |

(52) U.S. Cl.
CPC ..... *H01H 85/06* (2013.01); *H01H 85/11* (2013.01); *H01H 85/20* (2013.01); *H01H 85/205* (2013.01)

(58) Field of Classification Search
USPC ..... 337/295
See application file for complete search history.

(56) References Cited

U.S. PATENT DOCUMENTS 4,315,235 A * 2/1982 Jacobs, Jr. ..... H01H 85/06 337/161
4,357,588 A * 11/1982 Leach ..... H01H 85/055 337/160
5,898,357 A 4/1999 Endo et al.
5,900,798 A 5/1999 Hanazaki et al.
5,923,239 A * 7/1999 Krueger ..... H01H 69/022 337/152
6,043,966 A * 3/2000 Krueger ..... H01H 69/022 361/104
6,163,244 A * 12/2000 Endo ..... H01H 69/02 337/159
6,570,482 B2 * 5/2003 Brown ..... H01H 85/11 337/159
7,385,475 B2 * 6/2008 Bender ..... H01H 69/022 337/227
8,339,235 B2 * 12/2012 Beckert ..... H01H 85/0417 337/159
2007/0018774 A1 1/2007 Dietsch et al.
2009/0189730 A1 * 7/2009 Oh ..... H01H 85/10 337/186

* cited by examiner

FUSE ELEMENT, A FUSE, A METHOD FOR PRODUCING A FUSE, SMD FUSE AND SMD CIRCUIT

The present invention relates to a fuse element, a fuse, a method for producing a fuse, an SMD fuse and an SMD circuit.

BACKGROUND

Small surface-mounted hardware protection devices (surface-mounted devices SMD) or fuses are required for many circuit applications, e.g. in automotive engineering, measurement and control technology etc. For technical and cost reasons, such fuses are realised as conventionally used in printed circuit technology. SMD fuses, which comprise melting fuses, are mostly positioned and placed automatically by automatic pick-and-place machines on FR4 printed circuit boards. SMD fuses are subsequently soldered by means of reflow soldering processes or wave soldering processes onto the printed circuit board. FR4 printed circuit board materials or $Al_2O_3$ ceramics are used for example as base materials for SMD fuses, i.e. all conventional base materials for the production of printed circuit boards.

Fuses comprise a fuse element arranged on a base support, which fuse element comprises copper for example. The fuse element is usually used for protection from overcurrents and thus protects the subsequent electronic components.

Fuses come with the disadvantage that the base supports usually have limited operating temperatures. The operating temperature of a base support made of FR4 base material is thus only 200° C. for example. Higher temperatures damage the FR4 base material. In this case, the material delaminates and the fuse element which mostly consists of a cover film detaches from the base support. Decomposition and charring of the material occurs after a short period of time. Conductive layers are produced by the charring, with a comparatively low electrical resistance, which then produce impermissibly low insulation resistances.

In order to remedy this problem it is known to produce the base support from an $Al_2O_3$ ceramic material, which can withstand substantially higher temperatures than 200° C. for example without being damaged. It has proven to be disadvantageous however that the coefficient of thermal expansion (CTE) of said $Al_2O_3$ ceramic material is mostly less than 8 ppm/K and thus differs strongly from the coefficient of thermal expansion CTE of copper, which is 17 ppm/K. As a result of this high difference between the coefficient of thermal expansion of the base support made of $Al_2O_3$ ceramic material and copper, mechanical tensions occur between the copper fuse element and the ceramic base support. This leads to an increased likelihood of breakage. Furthermore, ceramic substrates are generally very brittle and drain a large amount of thermal energy from the fuse element. As a result, fuses with low nominal currents and rapid characteristics on this $Al_2O_3$ ceramic material are difficult to realise. Furthermore, these ceramic fuses frequently break once the fuse element is loaded by torsion or bending.

There is a disadvantage in the prior art that thermal fuses cannot be soldered on the basis of SMD by means of a reflow soldering process for example. The reason is that the known thermal fuses will trigger immediately under the thus occurring high temperatures in a range of 240° C. to 265° C.

SUMMARY

It is an object of the present invention to provide a fuse element, a fuse, a method for producing a fuse, an SMD fuse and an SMD circuit in which the previously mentioned problems are solved.

This object is achieved by a fuse element according to the claims.

In accordance with the invention, the fuse element comprises two connecting contacts and an interposed conductive track, wherein the conductive track has a reduced line cross-section in relation to the connecting contacts at least in some sections, further comprising at least one overlay, wherein the fuse element and the overlay each comprise materials which undergo diffusion when a predetermined ambient temperature is exceeded and when an electric current is conducted by the fuse element.

A fuse element is thus created in a surprisingly simple way, which does not trigger under the high temperatures occurring during the soldering, but is triggered in operation at high ambient temperatures of more than 200° C. for example.

This advantage is achieved by a diffusion process, which is activated once the ambient temperature exceeds a predetermined temperature of 200° C. for example and in addition an electric current (e.g. a nominal current) flows through the fuse element. This diffusion process occurs in a region in which the at least one overlay is in connection with the fuse element (also known as diffusion zone). Under these conditions, the diffusion process comprises an infusion of the atoms of the material of the fuse element into the material of the overlay. An alloy of these two materials is thus formed. As a result of the diffusion process, the diffusion zone becomes highly resistive with a high power loss of $P=I_n^2 \times R$ even at nominal current. As a result, the melting temperature of the diffusion zone decreases from 1080° C. to approximately 500° C. Within this diffusion zone, the reduced melting temperature of approximately 500° C. is already achieved even at low currents (e.g. nominal current), as a result of which the fuse element will trigger and the current circuit is advantageously reliably interrupted. In addition to the new property of the fuse for protection against overtemperature, the fuse maintains the property under the original conditions to continue to act as a fuse for protection against overcurrent. One relevant advantage of the fuse in accordance with the invention is that the fuse triggers in operation at predetermined high ambient temperatures (overtemperature threshold value) of more than 200° C. for example, even when no overcurrent is flowing. The term triggering means here a melting or fusing of the fuse element.

The line cross-section of the conductive track is reduced at least in some sections in a plane perpendicularly to the longitudinal direction of the fuse element in relation to the line cross-section of the connecting contacts. This relation has a value of less than 1 (<1). For example, the line cross-sections of the connecting contacts are constant in relation to each other. A fuse element is thus created which shows an H-profile in a view from above. The fuse element can obviously also have a different profile as long as the areas of the connecting contacts are as large as possible in relation to the conductive track. The areas of the connecting contacts can be rectangular, circular, elliptical or triangular. The fuse can be formed by punching out an integral material. The fuse element can alternatively be formed by cutting, e.g. by means of a laser.

The respective ambient temperature at which the fuse element triggers can be predetermined by pre-selecting the relation of the line cross-section of the conductive track to the line cross-section of the connecting contacts. By making a respective selection of the aforementioned relation, an overcurrent threshold value can also be defined from which the fuse element will trigger.

It is a further relevant advantage that a fuse based on SMD which is provided with such a fuse element can be connected by a reflow soldering process to the printed circuit board for example without the fuse element triggering at the high temperatures occurring in this process. Since no current flows in the course of this process (reflow soldering process), these high temperatures also do not cause any change in the fuse element. As a result, a fuse provided with this fuse element can easily be soldered by a reflow soldering process according to JEDEC standard (240° C. to 265° C., 10 s) onto the printed circuit board.

Preferably, the at least one overlay is arranged at least in sections within the conductive track. It is thus reliably ensured that in the case of triggering of the fuse element, i.e. during melting or fusing of the conductive track of the fuse element, no current flows between the connecting contacts. Triggering characteristics of the conductive track of the fuse element can be determined via a respective selection of the respective extension of the overlay provided to the fuse element (e.g. length, width and thickness in relation to the fuse element).

The at least one overlay is preferably arranged within the conductive track adjacent to one of the connecting contacts of the fuse element. As a result, the diffusion zone can be positioned especially closely to an adjoining electronic component (e.g. power transistor) which is to be protected with respect to overcurrent and overtemperature. An overlay adjacent to a connecting contact can be provided or two overlays can be provided which are respectively adjacent to the two connecting contacts. Fuses are increasingly needed for protecting power transistors on circuit boards for application in high-energy installations such as in automotive engineering, heating and venting technology, renewable energy etc. High-energy applications are controlled optimally nowadays in order to reduce energy consumption for example. Power transistors often operate in this case in pulsed operation. In error-free operation, the maximum thermal load of the power transistors in pulsed operation is not exceeded. If the power transistors are triggered by a constant signal in the case of a fault for example or if the power transistor is damaged, high temperatures of more than 200° C. occur in the power transistor for example. This leads to a fire hazard. This hazard is reduced by the fuse element in accordance with the invention, which will trigger immediately upon exceeding a predetermined high temperature. This advantageous effect is increased even further in that the fuse is mounted in direct vicinity to the power transistor. By arranging the diffusion zone, i.e. the overlay, in a region of the conductive track adjacent to one of the connecting contacts of the fuse element, i.e. by providing the diffusion zone close to the contact of the fuse element and thus as close as possible to the power transistor, the reliability of triggering of the fuse element can be increased even further.

It is a further advantage of this arrangement that a base support underlying the fuse element has a reduced thermal conductivity in the boundary region, i.e. adjacent to one of the connecting contacts of the fuse element, than in the middle region for example. By thus arranging the diffusion zone in a region of the base carrier which is as far as possible off-centre, i.e. in a region adjacent to one of the contacts of the fuse element, the exceeding of a predetermined ambient temperature of 200° C. for example is detected more rapidly and more reliably and will thus directly lead to the triggering of the fuse element. This effect is supported in that the surface area of a respective connecting contact is formed as large as possible in relation to the conductive track, when seen in a top view of the fuse element. As a result, the connecting contacts have better properties for heat dissipation in relation to the conductive track. When seen in the longitudinal direction of the fuse element, the highest temperature values will thus advantageously occur in the centre of the conductive track. One of several design parameters is provided by the selection of the relation between the respective width of the connecting contacts and the width of the conductive track, as seen in the longitudinal direction of the fuse element, by means of which triggering of the fuse element can be predetermined at overtemperature and/or overcurrent. A further design parameter is provided by selecting whether one or two overlays are provided.

The line cross-section of the conductive track preferably increasingly converges to the line cross-section of the connecting contacts. The line cross-section of the conductive track can increase linearly or non-linearly. In this embodiment, the line cross-section of the conductive track increases in a step-by-step manner at the respective two ends of the conductive track with minimal line cross-section and increases to a maximum line cross-section which is equal to the line cross-section of the connecting contacts. The line cross-section of the connecting contacts can extend in a constant manner, originating from this section. In this embodiment, the fuse element assumes a shape which is similar to a bone in a top view.

Preferably, the at least one overlay is arranged at least in sections within the conductive track in a region of the line cross-section which increases step-by-step. This provides a further design parameter through which it is possible to determine from which temperature and/or from which current value the fuse shall trigger.

The at least one overlay is preferably arranged in a region of the conductive track with step-by-step increasing line cross-section adjacent to a section of the conductive track with minimal line cross-section. The fuse element thus triggers reliably at overtemperature and/or overcurrent.

The fuse element further preferably comprises at least one recess introduced into the conductive track in which the at least one overlay is arranged. The diffusion zone is thus thinned out in its entirety, so that a diffusion of the atoms of the material of the fuse element into the material of the overlay occurs more rapidly, which diffusion is necessary or sufficient for triggering the fuse element. The temperature threshold for triggering the fuse element decreases with decreasing material thickness of the conductive track of the fuse element in the region of the recess or with increasing depth of the recess. The current threshold value for triggering at overcurrent also decreases. As a result, the dimension of the recess is a relevant design parameter, by means of which the temperature threshold value and the current threshold value are set or defined.

The at least one recess is preferably oriented continuously transversely to the longitudinal direction of the conductive track. The fuse element is usually formed as an elongated, thin strip body. The recess is introduced into the material of the conductive track on the surface and perpendicularly to the direction of the current. In the case of triggering of the fuse element, the current flow can thus be interrupted completely. The recess is introduced into the conductive track by means of photolithography, a laser etc. This recess is then filled with the material of the overlay, e.g. by means of a galvanic process. The recess can be filled partly or completely. The recess can also be filled with the material of the overlay beyond the edge of the recess. One or several recesses can be provided, which are each filled with an overlay.

Preferably, the material of the fuse element comprises copper and the material of the overlay comprises tin. Conventional fuse elements for the protection against overcurrent are conventionally made of copper. With the selection of tin as the material of the overlay, an outstanding material has been found which under overtemperature and current flow through the fuse element enters into diffusion with copper as the material of the fuse element. In the case of the diffusion process, the copper atoms diffuse into the tin and a copper-tin alloy is thus formed. In normal operations, e.g. during conduction of a nominal current through the fuse element at ambient temperatures of 125° C. over a longer period of time, this load does not cause any changes in the fuse element.

The aforementioned object is also achieved by a fuse which comprises a fuse element and further a base support made of an electrically insulating material, wherein the fuse element is arranged on a surface of the base support. An FR4 base material or an $Al_2O_3$ ceramic material can be used for example as a base support. It is an advantage of this fuse that it reliably protects not only against overcurrent but in addition also against overtemperature. In contrast to known thermal fuses, the fuse in accordance with the invention does not trigger during soldering, e.g. by means of a reflow soldering process. Conventional thermal fuses would immediately trigger at the respectively necessary high temperatures of 240° C. to 265° C. for example, so that complex countermeasures are currently taken such as the provision of wire terminations. As a result of the special advantage of the fuse in accordance with the invention, automatic assembly is possible and the workload is strongly reduced in contrast to the prior art because the provision of wire terminations can be avoided for example. Furthermore, the fuse in accordance with the invention is cheaper and much smaller than previously known thermal fuses. The fuse further meets all known approbations (IEC 60127 and UL248-14 standard). Furthermore, the fuse is resistant to strong current pulses.

The fuse elements are preferably arranged on opposite surfaces of the base support. As a result, a fuse can be provided on the basis of a multilayer construction with two fuse elements in parallel connection. For example, the diffusion zones of the individual fuse elements can be arranged in mutually offset positions in relation to the longitudinal direction. Further reliable triggering of the fuse in the case of overtemperature is thus ensured.

The fuse further preferably comprises two base contacts, which are respectively electrically connected via connecting contacts of the fuse elements which are opposite the base support. A fuse is thus created in a simple way which comprises fuse elements which are switched in parallel. These base contacts can also be made of copper.

The base support preferably comprises a Rogers4000 material. Conventional fuses are mostly assembled of base supports which comprise FR4 base materials or circuit board materials or $Al_2O_3$ ceramic materials for example. The FR4 base material consists of a glass fabric which is reinforced with an epoxy resin. This material shows good coefficients of expansion in the X and Y directions. These coefficients of expansion lie in the range of 14 to 17 ppm/K and come very close to the coefficient of expansion of copper as the material of the fuse element with 17 ppm/K. Copper foils, which have different thicknesses such as 6, 9, 12, 18, 35, 70, 120 and 240 μm, are pressed onto the FR4 base material under pressure and temperature and form the basis for the fuse element. The limited operating temperatures of the FR4 base materials have a disadvantageous effect, which are approximately at most 200° C. Even higher temperatures will damage the FR4 base material. In this case, the FR4 base material delaminates and a copper foil which is provided as a fuse element for example detaches from the FR4 base material. This is followed by decomposition and charring of the FR4 base material. The charring produces conductive layers of relatively low resistance, which thus produce impermissibly low insulation resistances.

As already described above, it is also known to provide an $Al_2O_3$ ceramic as the material of the base support. This ceramic material withstands higher temperatures in comparison with the FR4 base material. However, the coefficient of expansion of this ceramic material of less than 8 ppm/K is very low, leading to mechanical tensions (likelihood of breakage) between the fuse element made of copper and the ceramic material. Furthermore, ceramic substrates are very brittle and withdraw much thermal energy from the fuse element. A fuse with low nominal currents and rapid characteristics is thus difficult to realise on the basis of an $Al_2O_3$ ceramic as the material of the base support. Furthermore, such a fuse breaks easily under torsional or flexural loading of the fuse element.

All advantages of the $Al_2O_3$ ceramic material and the FR4 base material are combined by using Rogers4000 material as the material of the base support, as proposed. The Rogers4000 material is therefore exceptionally suitable as material of the base support of the fuse. This applies to all types and sizes of the base support. The Rogers4000 material is further compatible with all circuit board processes and is permanently resistant even at temperatures of up to 300° C.

The at least one fuse element is preferably coated with a protective lacquer, especially a protective polymer lacquer. The fuse element is thus reliably protected against environmental influences.

The aforementioned object is also achieved by a method for producing a fuse, wherein the method comprises the following steps: providing at least one fuse element, comprising two connection contacts and an interposed conductive track, such that the conductive track has a line cross-section which is reduced at least in sections in relation to the connecting contacts; providing a base support; providing the fuse element with at least one overlay, wherein the fuse element and the overlay are each selected from materials which enter into diffusion upon exceeding a predetermined ambient temperature and upon conduction of an electric current through the fuse element; and arrangement of the at least one fuse element on the base support. A fuse is provided by the method in accordance with the invention which triggers rapidly and reliably upon overtemperature. Furthermore, said fuse can be produced at low cost with only a few steps.

The ambient temperature (overtemperature threshold value) at which the fuse element shall trigger is predetermined by the respective selection of the relation between the line cross-section of the conductive track and the line cross-section of the connecting contacts. As a result of this selection of the relation, an overcurrent threshold value can also be defined from which the fuse element will trigger. The line cross-section of the conductive track is reduced in a plane perpendicularly to the longitudinal direction of the fuse element in relation to the line cross-section of the connecting contacts. A fuse element is thus created which shows an H-profile in a view from above. Alternatively, the line cross-section of the fuse element can grow linearly or non-linearly on the line cross-section of the connecting contacts. As a result, a fuse element is created which corresponds to a bone profile when seen in a top view. In the case of overtemperature and/or overcurrent, the fuse element will always trigger in the section with the reduced line cross-section, i.e. in the progression of the conductive track. The fuse element is formed for example by punching from an integral material. The fuse element is alternatively formed by cutting, e.g. by means of a laser.

The at least one overlay is preferably arranged in sections within the conductive track of the fuse element. The current flow between the connecting contacts is thus reliably interrupted upon triggering of the fuse element, i.e. during melting or fusing of the conductive track.

The at least one overlay is preferably arranged within the conductive track, adjacent to one of the connecting contacts of the fuse element. The diffusion zone can be arranged in close proximity to an electronic component to be protected, e.g. a power transistor, by arranging the overlay in a region adjacent to one of the connecting contacts of the fuse element. As a result of the close proximity to this electronic component, reliability can be increased even further with which the fuse element will trigger rapidly and reliably upon exceeding a predetermined temperature.

The step of providing the fuse element with at least one overlay preferably comprises arranging the overlay in at least one recess introduced into the conductive track. A temperature threshold can be determined or defined depending on the dimensions of the recess (length, width and geometry as seen in the longitudinal direction of the fuse element) and the depth of the recess where the fuse will trigger when said temperature threshold is exceeded. Triggering characteristics of the fuse element can thus be determined in a simple way.

The aforementioned object is also achieved by an SMD fuse, which comprises a melting fuse. This allows the assembly of an SMD circuit board with an SMD fuse as a thermal element.

The aforementioned object is also achieved by an SMD circuit, which comprises an SMD fuse. This creates an SMD circuit which comprises at least one SMD fuse for thermal monitoring of individual electronic components.

BRIEF DESCRIPTION OF THE DRAWINGS

Embodiments of the present invention are explained below in closer detail by reference to drawings, wherein.

DETAILED DESCRIPTION

Figure 1:
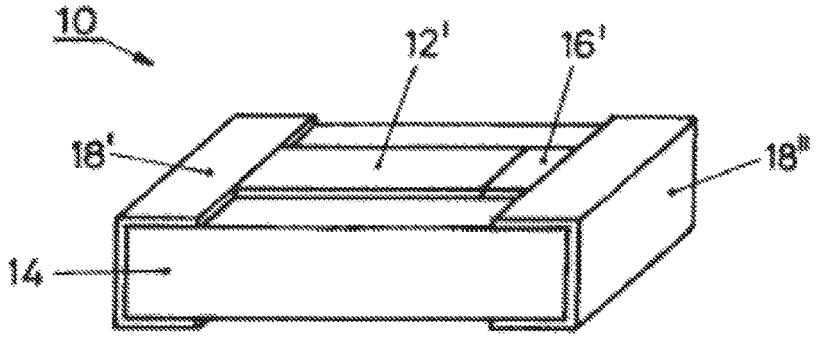
FIG. 1 shows a fuse in accordance with the invention in a perspective view.
Figure 2:
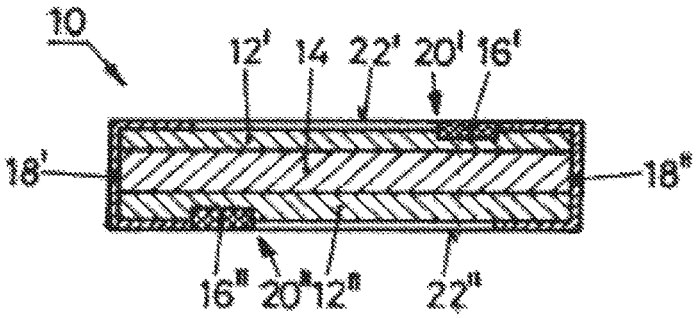
FIG. 2 shows a sectional view of the fuse according to the invention which is shown in FIG. 1.

With respect to FIGS. 1 and 2, a fuse 10 in accordance with the invention comprises two fuse elements 12', 12", which are each arranged on surfaces of a base support 14 which are opposite of each other as seen in the longitudinal direction of the fuse 10. The base support 14 consists of an electrically insulating material, which is permanently resistant even at high temperatures of up to 300° C. for example. Rogers4000 material is used in an especially preferably way as the material of the base support 14. The fuse elements 12', 12" resting on the base support 14 are each provided on their surface facing the exterior side with an overlay 16', 16". The overlays 16', 16" each extend in a region of the fuse elements 12', 12" which extend transversely to the direction of the current.

The respective ends of the opposite fuse elements 12', 12", which are also known as the connecting contacts, which are situated on one plane as seen in the longitudinal sectional direction of the fuse 10, are electrically connected to each other via base contacts 18', 18". Said base contacts 18', 18" are used as connections of the fuse 10 for conducting an electric current in the longitudinal direction of the fuse 10. The fuse elements 12', 12" and the base contacts 18', 18" are made of copper for example. As soon as the current conducted through the fuse 10 exceeds a predetermined or defined current quantity (current threshold value), one of the fuse elements 12', 12" will melt or fuse in the conventional way. As a result of the thus reduced line cross-section, the further fuse element will thus also melt or fuse directly. The current path is thus interrupted.

In addition to this protection from overcurrent, the fuse 10 also offers protection from overtemperature. The aforementioned overlay 16', 16" comes to bear in this case. If the ambient temperature exceeds a predetermined temperature threshold value of 200° C. for example and if in addition an electric current flows through the fuse elements 12', 12", a diffusion process is activated in accordance with the invention in which the atoms of the material of the fuse element (copper) diffuse into the material of the overlay 16', 16". The material of the overlay 16', 16" is made of tin as the diffusion partner for this purpose. In this example, a copper-tin alloy is formed by the diffusion of the copper atoms into the tin overlay. As will be explained below in closer detail, the overlay 16', 16" is filled into a recess 20', 20" introduced into the material of the fuse element 12', 12" for amplifying the diffusion process.

Once the ambient temperature has reached or exceeds the predetermined temperature threshold, the copper layer diffuses completely into the tin layer. A high-resistant diffusion zone with high power loss of $P=I_n^2 \times R$ is produced even at nominal current. In this case, the melting temperature of the diffusion zone decreases from 1080° C. to approximately 500° C.

The diffusion zone is designed by a respective selection of design parameters such as extension, selection of material etc in such a way that the reduced melting temperature of approximately 500° C. is already reached at relatively low currents and the current circuit is thus interrupted reliably by triggering or fusing the fuse element 12', 12" at the position of the diffusion zone. As a result, the fuse 10 also triggers at predetermined ambient temperatures (overtemperature), e.g. more than 200° C., when no overcurrent is flowing. The functionality and the advantage of the fuse 10 will be explained below by examining the fuse elements in closer detail.

Figure 3:
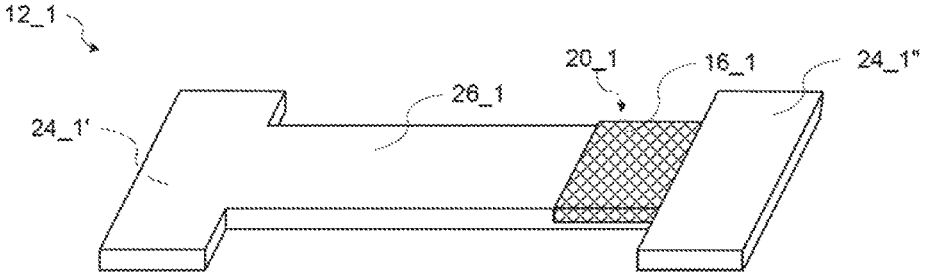
FIG. 3 shows a fuse element according to a first embodiment of the invention in a perspective view.
Figure 4:
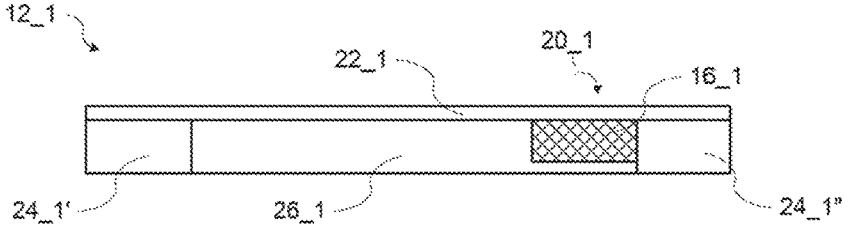
FIG. 4 shows a sectional view of the fuse element according to the first embodiment of the invention as shown in FIG. 3.

FIGS. 3 and 4 show detailed views of a fuse element 12_1 according to a first embodiment of the invention in a perspective view and in a sectional view, respectively. The fuse element 12_1 is integrally assembled of two connecting contacts 24_1', 24_1" and a conductive track 26_1 arranged between the connecting contacts 24_1', 24_1", wherein the conductive track 26_1 has a line cross-section which is continuously reduced in relation to the connecting contacts 24_1', 24_1". The line cross-section of the conductive track 26_1 is constant over the entire extension of the conductive track 26_1. Furthermore, the connecting contacts 24_1', 24_1" have a relatively large area in relation to the conductive track 26_1. As a result of this configuration, a substantially higher amount of heat dissipation is provided in the region of the connecting contacts 24_1', 24_1" than in the region of the conductive track 26_1 itself. As seen in the longitudinal direction of the fuse element 12_1, the temperature is highest approximately in the middle of the conductive track 26_1 and decreases in the direction toward the two connecting contacts 24_1', 24_1".

As seen in a top view, the exterior shape of the fuse element 12_1 assumes an H-profile. The connecting contacts 24_1', 24_1" are formed in a rectangular way, wherein the connecting contacts 24_1', 24_1" can also assume other shapes as long as generally, as seen in a plane perpendicularly to the longitudinal direction of the fuse element, the line cross-section of the conductive track 26_1 is reduced in relation to the line cross-section of the connecting contacts 24_1', 24_1". For example, the fuse element 12_1 is formed by punching out an integral material (e.g. copper). Alternatively, the fuse element 12 can be formed by cutting, e.g. by means of laser.

The support 16_1 is filled into the recess 20_1 which is introduced into the material of the conductive track 26_1. Although not shown in FIGS. 3 and 4, recesses with respectively filled overlay is can be provided on both end sections of the conductive track 26_1, at the converging points to the connecting contacts 24_1', 24_1". One of the design parameters for setting or defining the temperature threshold is indicated by the line cross-section of the conductive track 26_1 which is reduced in the region of the recess 20_1. The temperature threshold is reduced increasingly with decreasing line cross-section of the conductive track 26_1 (copper). As a result, the geometric shape of the recess 20_1 generally provides a possibility for setting or defining the temperature threshold. Once the outer temperature exceeds this temperature threshold, this leads to melting or fusing of the fuse element 12_1 in the region of the conductive track 26_1. The quantity of the material of the overlay 16_1, which means the quantity of tin, acts as a further design parameter for setting or defining the temperature threshold. A further design parameter for setting or defining the temperature threshold is indicated by the selection of the material composition of the two diffusion partners. In addition to the diffusion partners of copper and tin that are presented here, further suitable diffusion parts can also be selected.

For the purpose of protecting the fuse element 12_1 against damaging exterior influences, it can be coated with a protective lacquer 22_1, e.g. a protective polymer lacquer (see FIG. 4).

Figure 5:
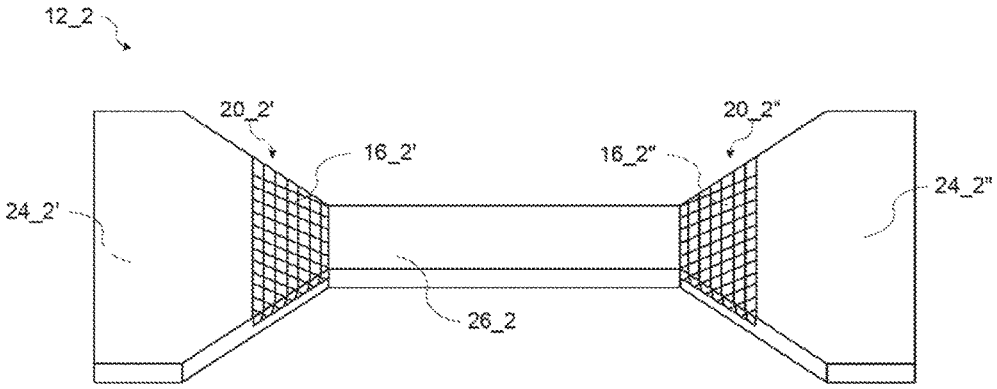
FIG. 5 shows a fuse element according to a second embodiment of the invention in a perspective view.
Figure 6:
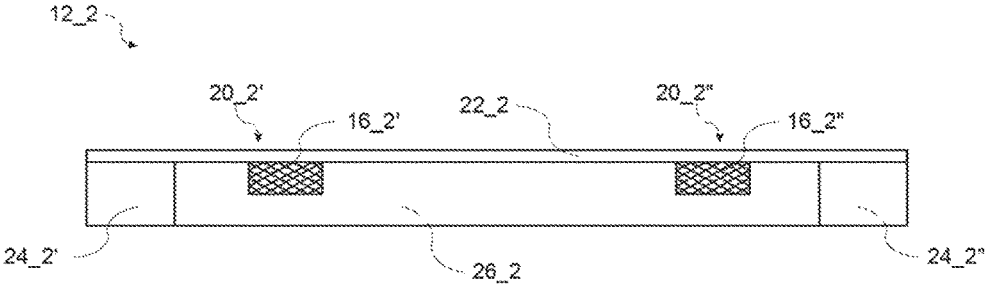
FIG. 6 shows a sectional view of the fuse element according to the second embodiment of the invention as shown in FIG. 5.

FIGS. 5 and 6 show detailed views of a fuse element 12_2 according to a second embodiment of the invention in a perspective view and a sectional view, respectively. The fuse element 12_2 is integrally made of two connecting contacts 24_2', 24_2" and a conductive track 26_2 arranged between the connecting contacts 24_2', 24_2", similar to the configuration of the fuse element 12_1 of the first embodiment as shown in FIGS. 4 and 5.

The fuse element 12_2 according to the second embodiment differs from the fuse element 12_1 according to the first embodiment in such a way that the line cross-section of the conductive track 26_2 at the two end sections approaches the greater line cross-section of the connecting contacts 24_2', 24_2" in a step-by-step manner. In contrast to the first embodiment, the line cross-section of the conductive track 26_2 is not constant over the entire extension of the conductive track 26_2.

As is shown in FIG. 5, the line cross-section increases linearly. When seen in a top view, the conductive track 26_2 comprises sections in the shape of an isosceles trapeze at its two ends. When seen in a top view, the exterior shape of the fuse element 12_2 thus assumes a bone-shaped profile. The line cross-section of the conductive track 26_2 can also alternatively increase in a non-linear manner, as a result of which the end sections of the conductive track 26_2, when seen in a top view, are provided with a geometric shape which differs from the isosceles trapeze.

The connecting contacts 24_2', 24_2" are further formed in a rectangular manner as seen in the top view, wherein they can also assume other geometric shapes as long as the line cross-section of the conductive track 26_2 decreases continuously toward the centre of the fuse element 12_2 in relation to the line cross-section of the connecting contacts 24_2', 24_2".

In contrast to the fuse element shown in FIGS. 3 and 4, the fuse element 12_2 according to the second embodiment comprises two recesses 20_2', 20_2", which are introduced into the material of the conductive track 26_2. The recesses 20_2', 20_2" are each arranged in those regions of the conductive track 26_2 in which the line cross-section decreases, as described above. In other words, the recesses 20_2', 20_2", when seen in a top view, are each arranged on the obtuse tips of the trapezoidal end sections of the conductive track 26_2.

Overlays 16_2', 16_2" are respectively filled into the recesses 20_2', 20_2". As a result of the line cross-section of the conductive track 26_2 which is thus reduced in the region of the recesses 20_2', 20_2" and in addition of the respective trapezoidal geometry of the end sections of the conductive track 26_2 as seen in the top view, one of a plurality of design parameters is indicated for setting or defining the temperature threshold. One possibility to set or define the temperature threshold is generally provided by choosing the geometrical shape of the recesses 20_2', 20_2". The fuse element 12_2 is coated with a protective lacquer 22_2 for protection against damaging external influences.

The fuse 10 shown in FIGS. 1 and 2 can be equipped on one side or both sides with one or several fuse elements 12_1 of the first embodiment (see FIGS. 3 and 4) or one or several fuse elements 12_2 of the second embodiment (see FIGS. 5 and 6). Combinations are also possible.

All told, a reliable fuse 10 for thermal and simultaneously electrical monitoring of power transistors arranged adjacent to each other is thus created. One advantage is that the fuse 10, despite the thermal fuse feature, is capable of being soldered via a direct reflow soldering process onto the circuit board without triggering. Since no current flows through the fuse element 12 in the course of this reflow soldering process, the high temperatures occurring in this process will not trigger the fuse element 12. Only in the operating state, i.e. when conducting a current such as a nominal current for example, will the fuse element 12 also trigger at overtemperatures, which can be lower than the temperatures occurring during the reflow soldering process.

As a result, an SMD fuse that has previously not existed is thus created, which can be placed and soldered automatically on SMD basis. As a result of the small form factor of the SMD fuse, it can advantageously be positioned especially close to a component that strongly develops heat, e.g. a power transistor. Once this component assumes a temperature which exceeds a predetermined temperature threshold, which is caused for example by a defect in the component itself or a defect in the circuit, the SMD fuse will trigger rapidly, as a result of which the current flow to said defective component is reliably interrupted.

The fuse 10 has the smallest possible form factor (e.g. 0201, 0402, 0603, 1206, 1812, 2010, 2512, 4018 etc). Furthermore, the fuse 10 shows high pulse loading capability because the fuse element 12 is fixed to the base support 14.

A multilayer construction with one or several fuse elements 12; 12', 12" in parallel connection is enabled. The fuse element 12; 12', 12" is completely protected from environmental influences by a protective lacquer 22; 22', 22". The use at maximum ambient temperatures of up to 280° C. is possible through a respective selection of the previously mentioned design parameters. Currents in the range of a few mA up to several hundred A can similarly be secured. As a result of the small form factor, the fuse 10 can advantageously be positioned especially close to electrical components that produce a large amount of heat, e.g. power transistors. This allows good thermal coupling, through which increased temperatures can be detected immediately, e.g. an increased temperature of the power transistor which is caused by a malfunction of the power transistor. Since the fuse 10 triggers immediately upon exceeding the defined overtemperature, the risk of a fire hazard is thus eliminated. In comparison with conventionally known thermal fuses the fuse 10 generally offers substantial improvements with respect to reliability, costs, size, weight, workmanship, pulse resistance, vibration resistance, response behaviour etc.

A fuse 10 is created which improves and expands previously known properties of fuses with respect to current/time behaviour, temperature behaviour, pulse strength, breaking capacity, insulation resistance, i2t values, material and production costs.

The invention claimed is:

1. A method for producing a fuse (10), comprising the steps of:

providing at least one fuse element (12; 12', 12") having two connecting contacts (24', 24") and an interposed conductive track (26), such that the conductive track (26) has a reduced line cross-section in relation to the connecting contacts (24', 24") at least in some sections;

providing a base support (14);

providing the fuse element (12; 12', 12") with at least one overlay (16; 16', 16"), wherein the fuse element (12; 12', 12") and the overlay (16; 16', 16") are each selected from materials which undergo diffusion when a predetermined ambient temperature is exceeded and when an electric current is conducted by the fuse element (12; 12', 12"), and wherein the fuse element is being connected to an external component by a reflow soldering process without the fuse element triggering at a reflow soldering process temperature occurring in this process, wherein the reflow soldering process temperature is higher than the predetermined ambient temperature, and arranging the at least one fuse element (12; 12', 12") on the base support (14), wherein the at least one overlay (16_1) is arranged within the conductive track (26_1) adjacent to one of the connecting contacts (24_1', 24_1") of the fuse element (12_1).

2. The method of claim 1, wherein the line cross-section of the conductive track (26) of the provided at least one fuse element (12; 12', 12") increasingly converges gradually to the line cross-section of the connecting contacts (24',24").

3. The method of fuse claim 2, wherein the at least one overlay (16; 16', 16") is arranged at least in sections within the conductive track (26) in a region of the gradually increasing line cross-section.

4. The method of to claim 2, wherein the at least one overlay (16; 16', 16") is arranged in a region of the conductive track (26) with a gradually increasing line cross-section adjacent to a section of the conductive track (26) with minimal line cross-section.

5. The method of claim 1, wherein the material of the fuse element (12; 12', 12") comprises copper and the material of the overlay (16; 16', 16") comprises tin.

6. The method of claim 1, wherein the support (14) is made of an electrically insulating material and, wherein the at least one fuse element (12; 12', 12") is arranged on a surface of the base support (14).

7. The method of claim 6, wherein the at least one fuse element (12', 12") is arranged on opposite surfaces of the base support (14).

8. The method of claim 6, further comprising providing two base contacts (18', 18") which are each electrically connected to connecting contacts of the at least one fuse element (12', 12") and which are located on opposite ends of the base support (14).

9. The method of claim 6, further comprising coating the at least one fuse element (12; 12', 12") with a protective lacquer (22; 22', 22"), especially a protective polymer lacquer.

10. A method of producing an SMD fuse, comprising the method of claim 6.

11. A method of producing an SMD circuit, comprising the method of claim 10.

12. The method according to claim 1, wherein the step of providing the fuse element (12; 12', 12") with the at least one overlay (16; 16', 16") comprises arranging the overlay (16; 16', 16") in at least one recess (20; 20', 20") introduced into the conductive track (26).

13. The method of to claim 12, wherein the at least one recess (20; 20', 20") is oriented in a continuously transverse manner in relation to the longitudinal direction of the conductive track (26).

* * * * *